US008262493B2

(12) United States Patent
Norris

(10) Patent No.: US 8,262,493 B2
(45) **Date of Patent: *Sep. 11, 2012**

(54) SYSTEMS AND METHODS FOR MARTIAL ARTS COMBAT

(76) Inventor: Carlos R. Norris, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/347,259

(22) Filed: Jan. 10, 2012

(65) Prior Publication Data

US 2012/0122597 A1 May 17, 2012

Related U.S. Application Data

(63) Continuation of application No. 11/808,020, filed on Jun. 6, 2007, now Pat. No. 8,109,835.

(60) Provisional application No. 60/811,099, filed on Jun. 6, 2006.

(51) Int. Cl.
*A63C 19/00* (2006.01)

(52) U.S. Cl. ..... 472/93

(58) Field of Classification Search ..... 273/440, 273/440.1; 472/93

See application file for complete search history.

(56) References Cited

U.S. PATENT DOCUMENTS

| | | | |
|---|---|---|---|
| 903,486 | A | 11/1908 | Laytham |
| D195,760 | S | 7/1963 | Martin |
| D215,578 | S | 10/1969 | Brown |
| 3,876,197 | A | 4/1975 | Jenson |
| 3,930,647 | A | 1/1976 | Berlemont |
| D253,781 | S | 12/1979 | Engalitcheff, Jr. |
| 4,911,443 | A | 3/1990 | Foster |
| D307,326 | S | 4/1990 | Smith |
| 4,935,970 | A | 6/1990 | Aristone |
| 5,531,453 | A | 7/1996 | Penston, III |
| D394,907 | S | 6/1998 | Duffy |
| 5,881,402 | A | 3/1999 | Devino et al. |
| D408,546 | S | 4/1999 | Carreau |
| 6,340,334 | B1 | 1/2002 | Olsen et al. |
| D480,817 | S | 10/2003 | Carreau |
| D485,618 | S | 1/2004 | Bonnin |
| D566,853 | S | 4/2008 | Norris |
| D582,050 | S | 12/2008 | McKinzie |
| D591,426 | S | 4/2009 | Norris |
| 7,607,403 | B2 | 10/2009 | Walters |
| 8,109,835 | B2 * | 2/2012 | Norris ..... 472/93 |
| 2008/0027571 | A1 | 1/2008 | Duval |

OTHER PUBLICATIONS

In the U.S. Patent and Trademark Office, Office Action in re: U.S Appl. No. 11/808,020, dated Dec. 9, 2009, 5 pages.
In the U.S. Patent and Trademark Office, Final Office Action in re: U.S. Appl. No. 11/808,020, dated Jul. 20, 2010, 6 pages.

(Continued)

*Primary Examiner* — Raleigh W. Chiu
(74) *Attorney, Agent, or Firm* — Patton Boggs LLP

(57) ABSTRACT

Systems and methods are provided relating to martial arts competitions including martial arts games, team competitions, and a martial arts combat league. A martial arts combat league may combine traditional aspects of martial arts competitions with the appeal of rooting for a favorite team or individual competitor. Martial arts competition rules and scoring systems may be provided for the martial arts combat league. A martial arts competition area may be provided for presentation of martial arts combat league events. A novel scoring system may involve and inform fans of the martial arts combat league.

22 Claims, 7 Drawing Sheets

OTHER PUBLICATIONS

In the U.S. Patent and Trademark Office, Office Action in re: U.S. Appl. No. 11/808,020, dated Feb. 2, 2011, 5 pages.
In the U.S. Patent and Trademark Office, Examiner's Interview Summary in re: U.S. Appl. No. 11/808,020, dated Apr. 29, 2011, 3 pages.
In the U.S. Patent and Trademark Office, Final Office Action in re: U.S. Appl. No. 11/808,020, dated Jun. 17, 2011, 6 pages.
In the U.S. Patent and Trademark Office, Notice of Allowance in re: U.S. Appl. No. 11/808,020, dated Oct. 27, 2011, 5 pages.

* cited by examiner

SYSTEMS AND METHODS FOR MARTIAL ARTS COMBAT

CROSS-REFERENCE TO RELATED APPLICATIONS

This application is a continuation of U.S. patent application Ser. No. 11/808,020, filed Jun. 6, 2007 which claims priority to U.S. Provisional Patent Application No. 60/811,099, filed Jun. 6, 2006; the contents of which are incorporated by reference herein in their entireties.

BACKGROUND OF INVENTION

1. Field of Invention

The invention relates generally to martial arts combat, and, more particularly to systems and methods for martial arts competitions including martial arts games, team competitions, and a martial arts combat league.

2. Description of Related Art

Martial arts may be considered one of the most popular participation sports in the United States and abroad. According to statistics from the National Association of Professional Martial Artists, an association for martial arts instructors and schools in the United States, there are over 28,000 martial arts schools in the United States, 72 American-based martial arts associations, 53 martial arts publications, 88 martial arts equipment and supply companies, 3 million martial arts websites, and over 600 martial arts tournaments in the United States each year. Estimates of persons participating in martial arts in the recent past vary between 18 and 25 million individuals. According to these estimates, 52% of persons participating in martial arts in the recent past may be over 18 years of age, and 48% may be under 18 years of age.

In addition to being a popular participation sport, martial arts are also an important source of entertainment. For example, nearly ninety four million adults saw martial arts-related movies in the United States in 2003. Six of the top grossing films of 2003 included martial arts themes. For nearly three decades martial arts themes have consistently drawn viewers to movies on the big screen and television. Martial arts related television programming has been similarly popular in the form of series television programs and sports specials. Strong cable television ratings for the annual U.S. Open World Martial Arts Championships, the world's largest martial arts tournament, and other televised martial arts competitions indicate that many individuals watching television want to see martial arts competitions on television.

Furthermore, the video game industry often features martial arts themes in video games produced for children and adults. Overall, there is a desire by consumers of entertainment media for martial arts related competitions and programming.

Martial arts competitions and games exist in many forms. However, many of the existing martial arts competitions and games do not encourage active fan participation or create loyal viewers that repeatedly watch or attend the martial arts competitions and games. In most cases, existing martial arts competitions and games are watched or attended by viewers as single, isolated events. Existing martial arts competitions and games do not engage viewers in a series of events or encourage identification of viewers with individual competitors or teams.

Needs exist for unique systems and methods for martial arts games and competitions that appeal to martial arts watching viewers and the general public.

SUMMARY OF INVENTION

Embodiments of the present invention solve many of the problems and/or overcome many of the drawbacks and disadvantages of the prior art by providing systems and methods for martial arts competitions including martial arts games, team competitions, and a martial arts combat league.

Embodiments of the present invention may include a martial arts league. The martial arts league may include a plurality of martial arts teams, a plurality of individual competitors on each martial arts team, a plurality of martial arts competitions between martial arts teams, the martial arts competitions comprising judging and rules. The teams may participate in the martial arts competitions to determine a winning martial arts team.

In preferred embodiments of the present invention, a plurality of individual competitors may use a variety of martial arts styles. The plurality of martial arts competitions may be part of a tournament. The winning martial arts team may be determined in a playoff. Individual competitors on each martial arts team may be both men and women.

The plurality of individual competitors can compete in rounds during the martial arts competition. The plurality of individual matches each may include a first round, a break, and a second round.

Embodiments of the present invention may include a scoring system for the teams, wherein the scoring system is used to determine the winning team for the martial arts league. The scoring system may include penalties for passivity or bonuses. Points from the scoring system may be cumulative between the plurality of individual matches. A tie may be broken with a sudden victory round to determine a winning martial arts team.

The plurality of martial arts teams may be divided into divisions. The plurality of martial arts competitions may be viewed by live television, taped television or Internet broadcast. The plurality of individual competitors on each martial arts team may wear team uniforms.

Embodiments of the present invention may also include a martial arts combat game. The martial arts combat game may include a plurality of teams, a plurality of competitors on the plurality of teams, a set of rules for martial arts combat, a scoring system for the martial arts combat, a penalty system for failure to comply with the set of rules, a judging system based upon the set of rules, the scoring system and the penalty system for determining a winner of the martial arts combat game, and wherein the plurality of competitors each face one opponent from a different team in individual matches.

The plurality of teams may compete in a series of martial arts combat games selected from the group consisting of pre-season exhibitions, regular season games, tournament games, and combinations thereof.

The set of rules may include fouls and restrictions on passivity. The scoring system may be a five point must system. The martial arts combat game may include martial arts demonstrations, exhibitions and record breaking attempts.

Scoring may be based on criteria selected from the group consisting of number of knockdowns, extent of damage inflicted, number of clean strikes scored, kicking effectiveness, aggressiveness, and combinations thereof. The criteria may be priority based criteria. The penalty system may include a penalty for passivity.

The judging system may be administered by one or more judges given scoring guidelines, and may preferably be administered by three judges. The judging system may include disqualifications.

The individual matches may be chosen by coaches, and the coaches may alternate selection of competitors for individual matches.

The individual matches may be two or more approximately two to three minute rounds. The martial arts combat game may be approximately six to eighteen total rounds with three to nine competitors on each team. The plurality of competitors may be preferably both men and women.

Embodiments of the present invention may include a playing area for the martial arts competition, a plurality of playing zones within the playing area, competition rules and scoring linked to the playing zones, and a series of martial arts matches executed within the playing area by competitors on martial arts teams.

The playing area may be a ring or a raised platform. The playing zones are preferably at least one of a circle and a ring. A league may include the martial arts teams. The system may include protective gear for the competitors.

A variety of martial arts fighting techniques may be used by the competitors.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF PREFERRED EMBODIMENTS

Figure 1:
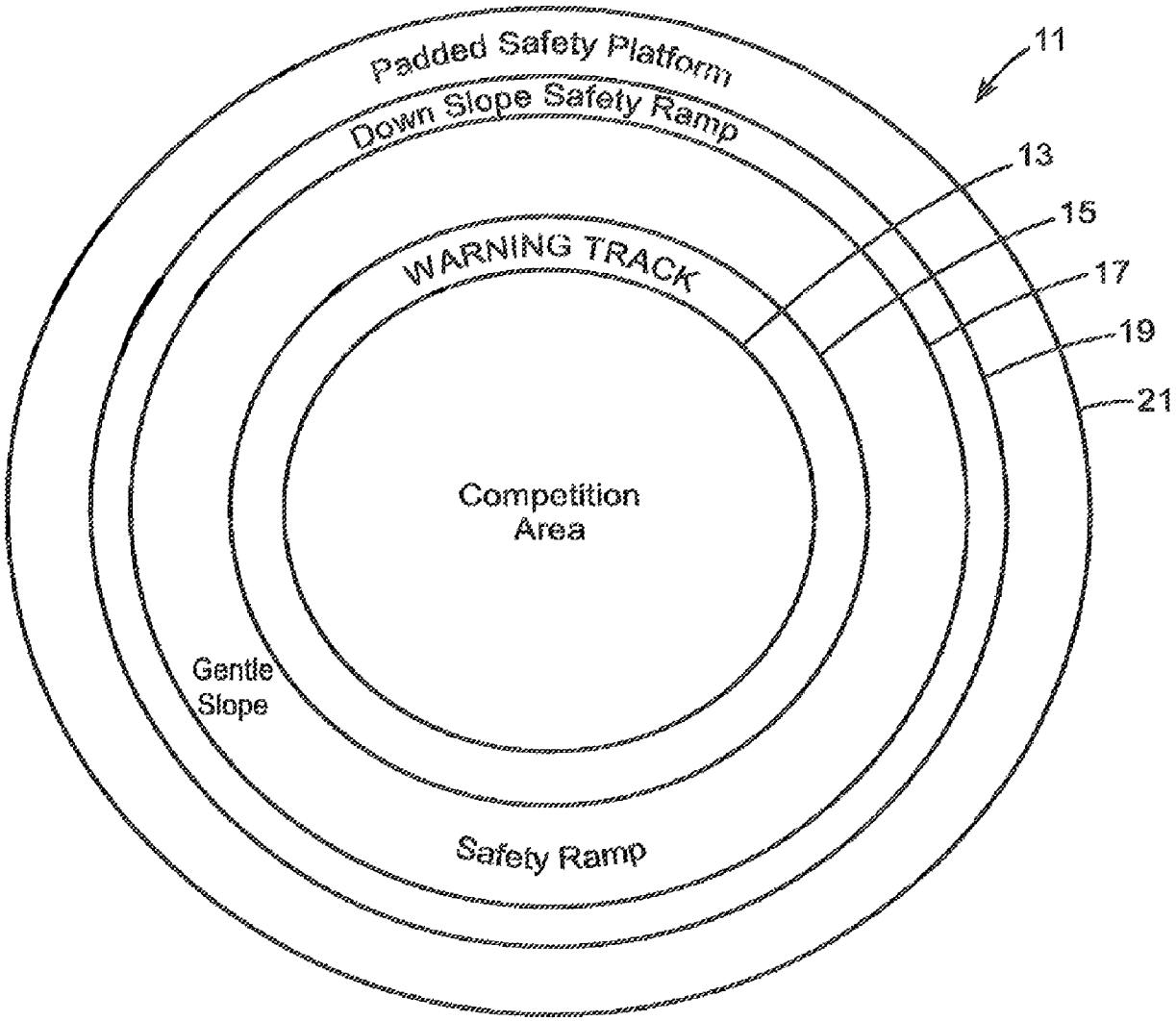
FIG. 1 is a top view of a competition ring.

Embodiments of the present invention may be directed to systems and methods relating to martial arts competitions including martial arts games, team competitions, and a martial arts combat league. A martial arts combat league of the present invention may combine traditional aspects of martial arts competitions with the appeal of rooting for a favorite team or individual competitor. Embodiments of the present invention may include unique combat martial arts competition rules for the martial arts combat league. Embodiments of the present invention may also include a unique martial arts competition area for presentation of the martial arts competitions. A novel scoring system may further involve and inform fans of the martial arts combat league.

Embodiments of the present invention may include a martial arts combat league with unique competitions and games having judging and a set of rules. The competitions and games may be team martial arts competitions. With martial arts games and leagues in accordance with the principles of the present invention, the intensity and focus of individual martial arts competitions may be combined with the excitement of cheering for a favorite team. The action of the competitions and games is preferably fast paced. Teams from competing cities in the United States and/or worldwide may face off against each other before live audiences, televised audiences, web casts, or in other media formats. The martial arts combat league of the present invention may bring martial arts combat fighting to mainstream audiences on a global level.

The martial arts combat league may encompass a full-contact martial arts team sport league that offers the benefits and attraction of full-contact martial arts fighting with the addition of a league format. The martial arts combat league may incorporate, for example, innovative rules and team formats that combine martial arts techniques from a variety of martial arts and related disciplines. Preferably, the action may be non-stop or nearly non-stop with numerous knock-outs and other events that encourage viewers to become fans after viewing the martial arts competitions. One martial arts team may be a winner each season. The winning team for each season may receive a title and/or trophy.

The martial arts games and leagues may combine martial arts, entertainment and business to create a popular sporting league. The martial arts combat league may employ well-known coaches and high-profile personality fighters. The martial arts combat league preferably attracts established martial arts fans, fans of boxing and other fighting competitions and general sports fans. The martial arts combat league preferably also has the ability to retain an initial viewer following as the martial arts combat league grows and attracts new marketing segments.

Preferably, there may be pre-season exhibition events to introduce viewers to the team fighting format under the new martial arts combat league rules. Pre-season events may be staged prior to an initial season and/or before the start of each subsequent season. Pre-season events may be held in venues for attracting sport fans. The pre-season events preferably generate attention and publicity for the upcoming regular season of the martial arts combat league.

Venues for martial arts combat league events may be strategically chosen for their proximity to the locations of teams. For example, in the United States, eastern division venues may include casinos and hotels from Connecticut to Florida. Western division venues may include casinos and hotels from California to Texas. Alternatively, more traditional venues may be chosen, such as arenas for basketball, hockey, etc.

The martial arts combat league may be divided into two or more divisions. For example, a western division may include teams from Los Angeles, San Francisco, Denver and Dallas. An eastern division may include teams from New York City, Washington, New England and Miami. Other teams and division set-ups are possible. The overall martial arts combat league may be expanded from approximately eight teams to anywhere from twelve to sixteen teams or more. Additional teams may be added based upon interest in other cities or regions. Expansion teams may include, for example, Chicago, Atlanta, New Orleans, Philadelphia, San Diego, San Antonio, Sacramento and Las Vegas. Teams may preferably compete monthly during a season. A season may be six months or longer. Alternatively, teams may compete bi-weekly during a season. Teams in each division may compete against each other with winning teams from each division competing for a martial arts combat league championship title and/or trophy.

The martial arts combat league may be extend to teams in countries outside the United States. The popularity of fighting sports in Europe, Asia, and South America may exceed the interest here in the United States. International promoters may develop teams in international cities or national teams for countries outside the United States. Domestic teams within the United States may compete with international teams or may be chosen to represent the United States in international competitions.

Each martial arts combat league event may include alternative martial arts action in addition to the competitions between martial arts teams. For example, demonstration teams and world record breaking attempts may be included during the martial arts combat league events. The martial arts combat league events may be viewed live, televised, web cast, or watched by viewers in any manner desired. The martial arts teams preferably garner city loyalty and build individual stars to develop an audience with team and fighter fan loyalty. Innovative production techniques and audience Internet interaction may be utilized to present a unique and exciting experience for fans of both live and taped replay telecasts.

In preferred embodiments of the present invention, eleven martial arts combat league events may be performed over a six month long season. Seasons of competition may be a set number of months or a set number of competitions. The seasons may culminate in a playoff-style format that ends with a two-team final martial arts competition to determine a winner for that season.

The teams may be composed of a set breakdown of men and women of various sizes and/or weight classes. Preferably, teams may be composed of five men and two women fighting for a specific team, but other team compositions may be used. The martial arts combat league athletes are preferably well-conditioned martial arts fighters with dynamic kicking skills. The athletes may be either professional or amateur with teams composed of exclusively professional or amateurs or a mixture of professionals and amateurs. Individual athletes may perform a mixture of several martial arts, competitors using a given martial art style may face off against each other or competitors using distinct martial arts styles may face off against each other. Preferably, each martial arts fighter only fights a total of two rounds during each martial arts combat league event with a rest period in between rounds. Alternatively, one, three or more rounds may be use. Preferably, each round is two to three minutes long, but other durations are possible. The reduction in number of rounds and rest between rounds may encourage each martial arts fighter to earn their team more points by fighting aggressively throughout each round.

A judge's scoring system and the referee's penalty point system may reward aggressive fighting and penalize passivity and/or attempts to stall. Ground fighting and delay tactics may be kept to a minimum.

Individual fighters in the martial arts combat league may wear specially designed uniforms. Both male and female fighters may wear team uniforms in team colors. The uniforms of the individual fighters may include long, martial arts style pants and minimum protective gear.

At the start of a martial arts competition both competing teams may enter a competition platform and stand with each individual fighter on a first team facing an individual fighter on a second team. The referee may preside over a "coin toss" or other method of determining priority. A coach of a team that wins the coin toss may be allowed to select which fighter from that team to start the martial arts competition. The selected fighter enters the competition platform with an opponent and a round of competition is commenced. After ending the first round of competition, the coach that lost the coin toss may be allowed the opportunity to select which of the fighters from that team compete in the next round. The choice option may rotate back and forth throughout the rest of the contest allowing the coaches to implement a fighter choice strategy that best serves the interest of the coaches' teams. All individual fighters may stay in a fighter's pen during rounds in which they are not competing. The individual fighters preferably must be prepared to enter the competition at any time based on the competing strategies of each coach.

At the end of each round the judges' scores may be announced and added to total points awarded from each of the previous rounds. Referee awarded bonus or penalty points may be added to the cumulative team scores if appropriate. Details of the scoring system are provided below. When each of the teams' athletes has completed one round of fighting, the martial arts combat league event may break for half-time.

During the break for half-time the coaches may advise team members on strategies for improving performance in the second half of the martial arts combat league event. At the start of the second half each original match-up that did not result in a knockout or total knockout may again be contested to conclude each fighter's second and final round. Fighters who were knocked out in the first half of the martial arts combat event may be replaced with back up fighters.

Alternatively, rounds fought between individual competitors may be consecutive with breaks between consecutive rounds. Breaks may be more or less than one minute depending on the competition format. Each pairing of individual competitors may compete in the pre-determined number of rounds before the next pairing of individual competitors compete. Points may be awarded at the conclusion of each round, or may be awarded at the end of all rounds.

The martial arts combat event may be scheduled for six to eighteen rounds, for example. Teams may have three to nine members with each athlete fighting two rounds against an opponent matched by sex and weight. Rounds may be two minutes or three minutes in duration. Other quantities and durations may be used in accordance with the principles of the invention. The team that has the most cumulative points when the final round is concluded may be the winner.

The martial arts combat systems and methods are preferably used in combination with a competition platform in accordance with the principles of the invention. Exemplary embodiments of a competition platform are shown in FIGS. 1-6.

The construction and configuration for the competition platforms as shown include both colors and grade/slope for integration into the martial arts competition. The platform preferably includes a ropeless and cornerless ring. The ring may include colored zones tied into playing rules. The ring may also include a sloped ramp tied into playing rules. For example, when a fighter enters a peripheral zone the referee may break action. If a fighter repeatedly enters the peripheral zone the referee may penalize the fighter with a passivity or stalling penalty. The following figures use a red/yellow/blue color scheme for identifying the relevant regions of a competition ring; however, other color or pattern schemes may be used. Alternatively, the figures use particular sizes and dimensions for the competition ring; however; other sizes and dimensions may be used depending on the competition and location. The following examples are exemplary and do not limit the invention.

FIG. 1 shows a preferred embodiment of a competition ring 11. The competition ring 11 may be a raised platform. The competition ring 11 may provide increased visibility for spectators and may provide more room for athletes to compete. Furthermore, the competition ring 11 may be ropeless and cornerless for athletes that are accustomed to competing on stage rather than in traditional boxing rings. The competition ring 11 may be generally circular. A main central region 13 may be color coded and the main central region 13 is preferably about 25 feet in diameter. A warning track 15 may surround the main central region 13. A safety ramp 17 may surround the warning track 15. The safety ramp 17 preferably gently slopes at a grade of 14% for about five feet. A down slope safety ramp 19 may surround the safety ramp 17. A padded safety platform 21 may surround the down slope safety ramp 19. The main central region 13, warning track 15, safety ramp 17, down slope safety ramp 19, padded safety platform 21, and/or any other part of the competition ring 11 or arena may include advertising for sponsors or the league itself.

Figure 2:
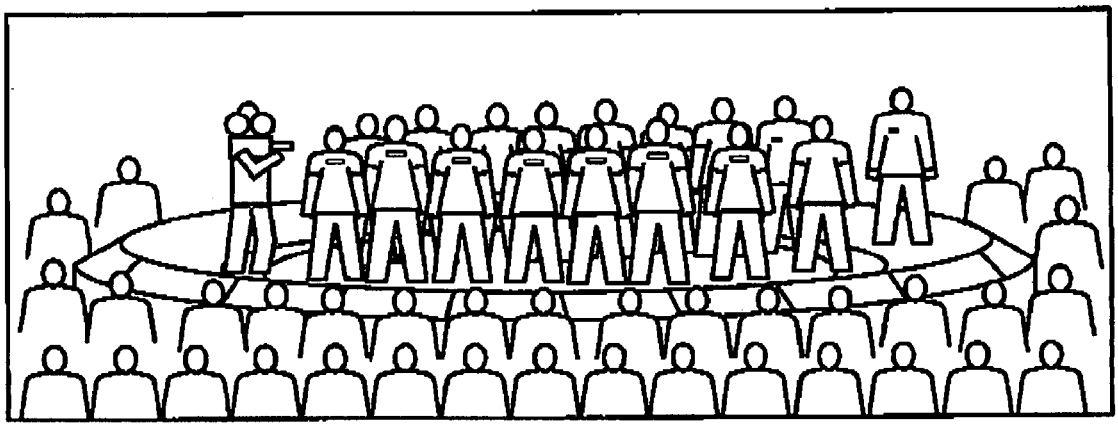
FIG. 2 is a perspective view of opposing teams facing one another before a competition.

FIG. 2 shows teams in the competition ring before the beginning of a first match-up. Both teams may enter the competition platform with each member wearing their complete team uniform. The teams may line up across from each other with each team member facing their opponent. Prior to the start of the contest both teams may bow to one or more officials and may bow to each other. The referee may administer pre-fight instructions.

Figure 3:
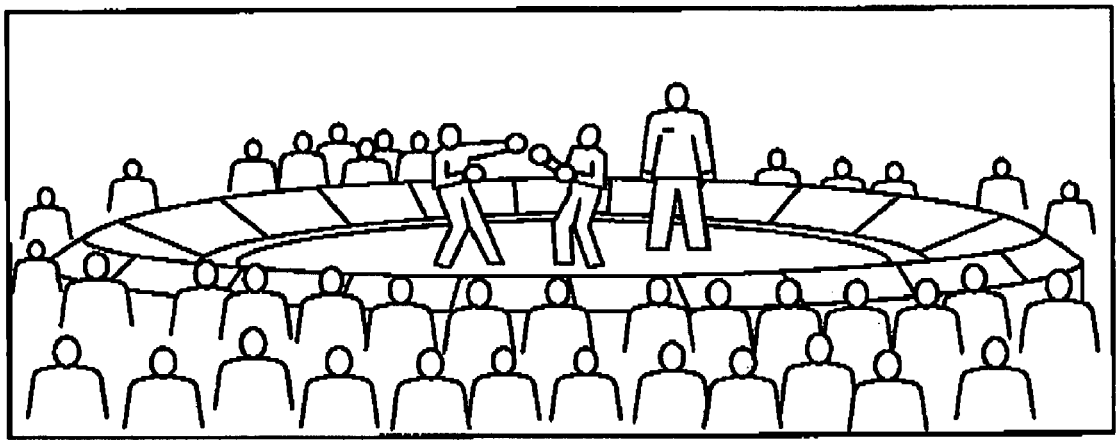
FIG. 3 is a perspective view of an individual match during the competition.

FIG. 3 shows an individual match. Individual fighters in a first match-up may remain in the ring after the beginning of the martial arts combat league event. Other individual fighters not in the first match-up may exit the competition platform and retire to a fighter's pen (not shown). The fighter's pen may be a warm-up area close to the competition platform. Failure to, at any time, show proper courtesy or to be prepared to compete, may be cause for penalization at a referee's discretion.

Figure 4A:
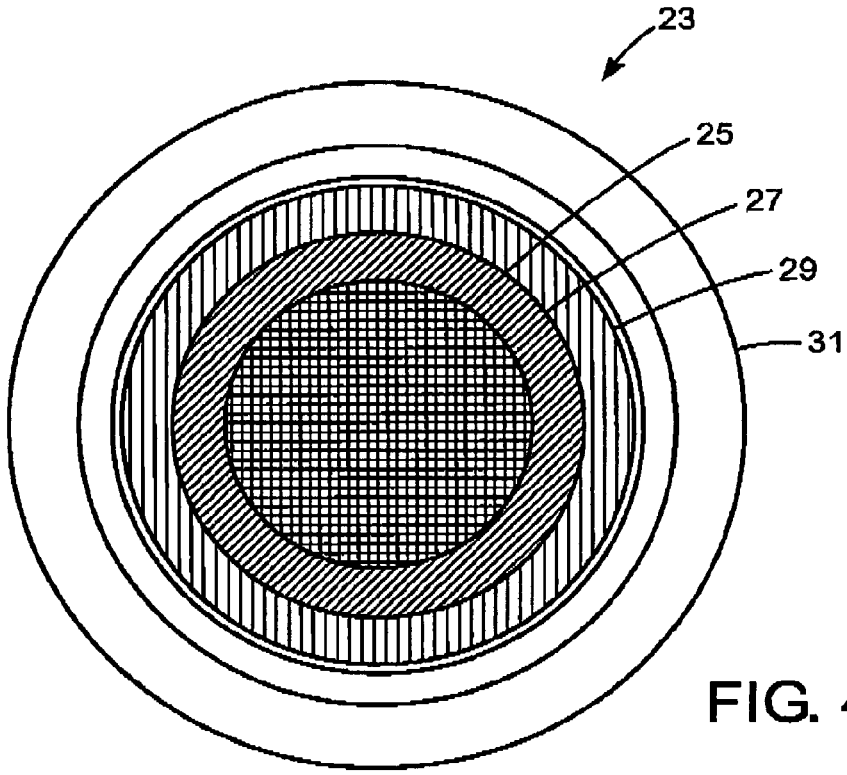
FIG. 4A is a top view of a competition ring with a medium sized blue zone.
Figure 4B:
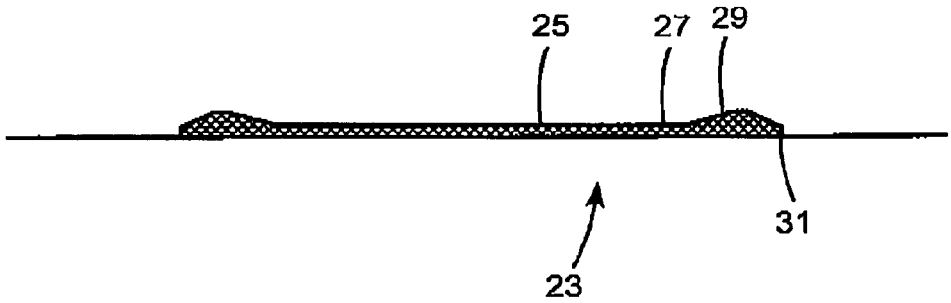
FIG. 4B is a vertical cross section of the competition ring of FIG. 4A.

FIG. 4A and FIG. 4B show a competition ring 23 with a medium sized blue zone 25. The blue zone 25 may be the main competition region. The blue zone 25 is preferably about eighteen feet in diameter. A yellow zone 27 may surround the blue zone 25 and is preferably about twenty four feet in diameter. The yellow zone 27 is preferably a warning track. A red zone 29 may surround the yellow zone 29 and is preferably about thirty one feet in diameter. The red zone 29 may be sloped upward for safety. An optional perimeter pad 31 may be added around the red zone 29 and is preferably about two feet wide.

Figure 5A:
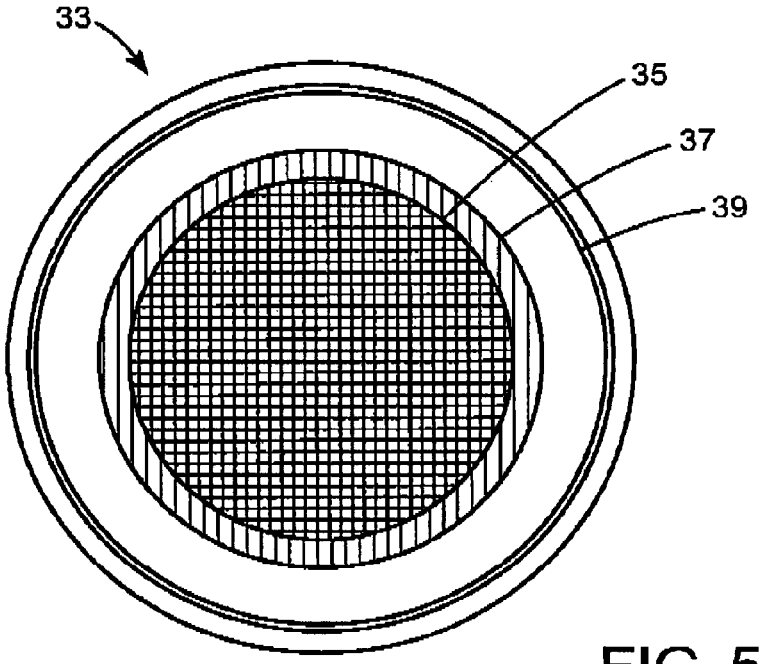
FIG. 5A is a top view of a competition ring with a large blue zone.
Figure 5B:
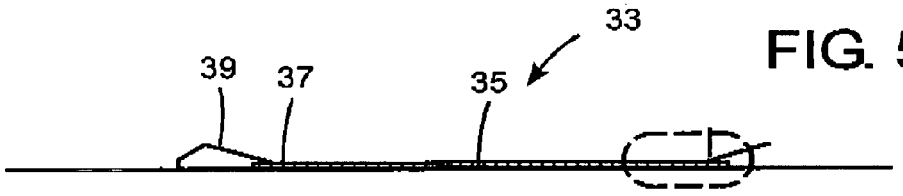
FIG. 5B is a vertical cross section of the competition ring of FIG. 5A.

FIG. 5A and FIG. 5B show a competition ring 33 with a large sized blue zone 35. The blue zone 35 may be the main competition region. The blue zone 35 is preferably about twenty one feet in diameter. A yellow zone 37 may surround the blue zone 35 and is preferably about twenty four feet in diameter. The yellow zone 37 is preferably a warning track. A red zone 39 may surround the yellow zone 39 and is preferably about thirty four feet in diameter. The red zone 39 may be sloped upward and then downward for safety.

Figure 5C:
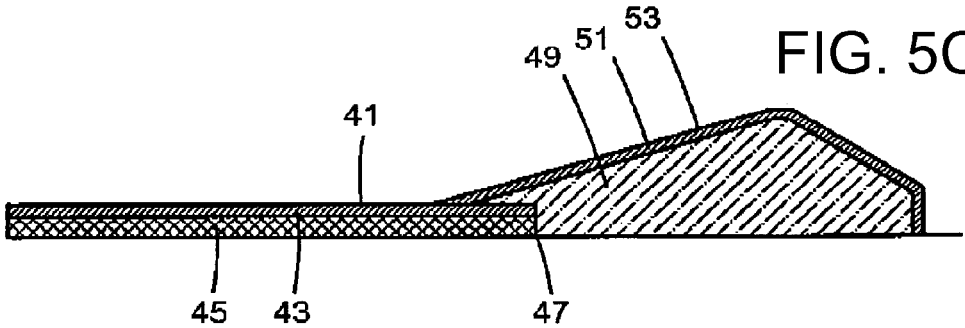
FIG. 5C is a detail of the competition ring of FIG. 5A.

FIG. 5C shows a detail of the sloped red zone 39. A vinyl canvas 41 preferably covers an interlocking soft approximately one inch foam sparring mat 43. The interlocking sparring mat 43 preferably sits on an approximately one to three inch dense foam base 45. A hook and loop perimeter fastening system 47 preferably attaches the interlocking sparring mat 43 to a fiberglass ring structure 49. The fiberglass ring structure 49 is preferably covered with an approximately one inch bonded foam or soft sparring mat 51. The bonded foam or soft sparring mat 51 is then preferably covered with bonded Lycra 53.

Figure 6A:
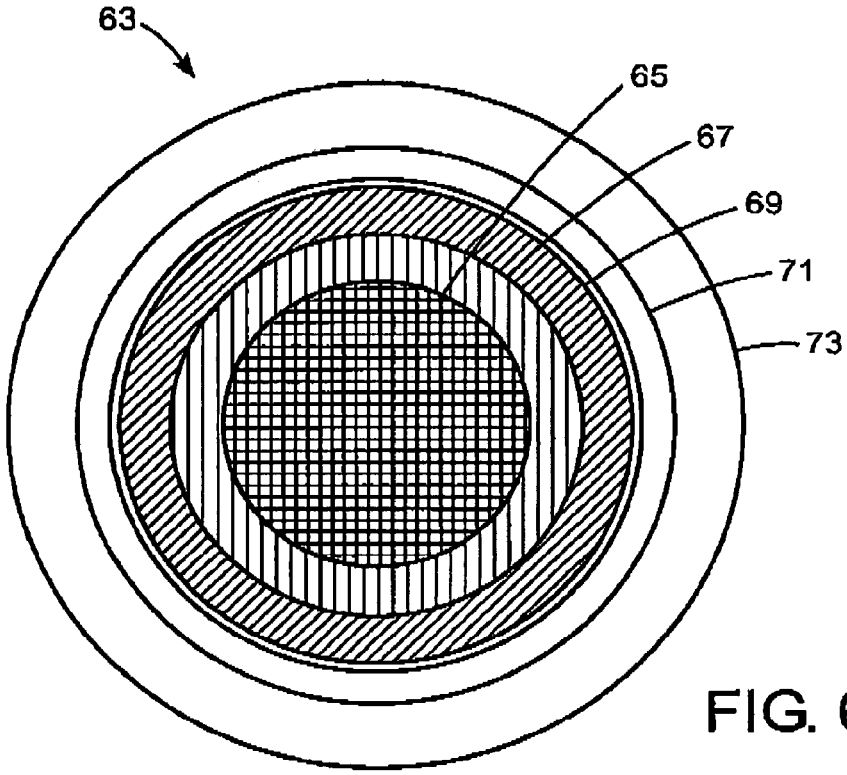
FIG. 6A is a top view of a competition ring with a small blue zone.
Figure 6B:
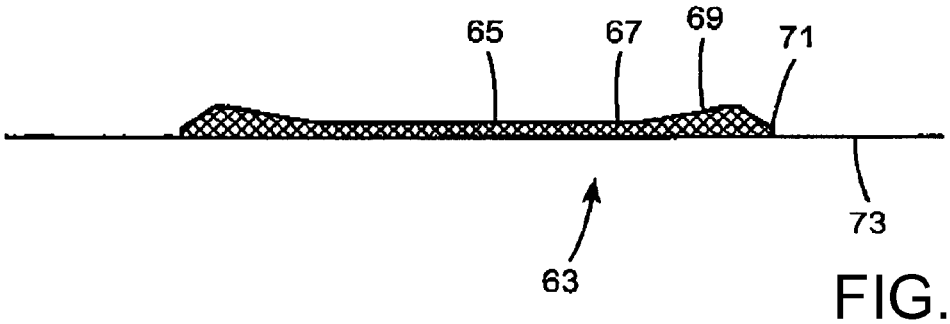
FIG. 6B is a vertical cross section of the competition ring of FIG. 6A.

FIG. 6A and FIG. 6B show a competition ring 63 with a small sized blue zone 65. The blue zone 65 may be the main competition region. The blue zone 65 is preferably about twelve feet in diameter. A yellow zone 67 may surround the blue zone 65 and is preferably about eighteen feet in diameter. The yellow zone 67 is preferably a warning track. A red zone 69 may surround the yellow zone 69 and is preferably about thirty feet in diameter. The red zone 69 may be sloped upward and downward for safety. An optional perimeter pad 71 may be added around the red zone 69 and is preferably about two feet wide. An optional floor mat 73 may surround the perimeter pad 71.

Figure 7A:
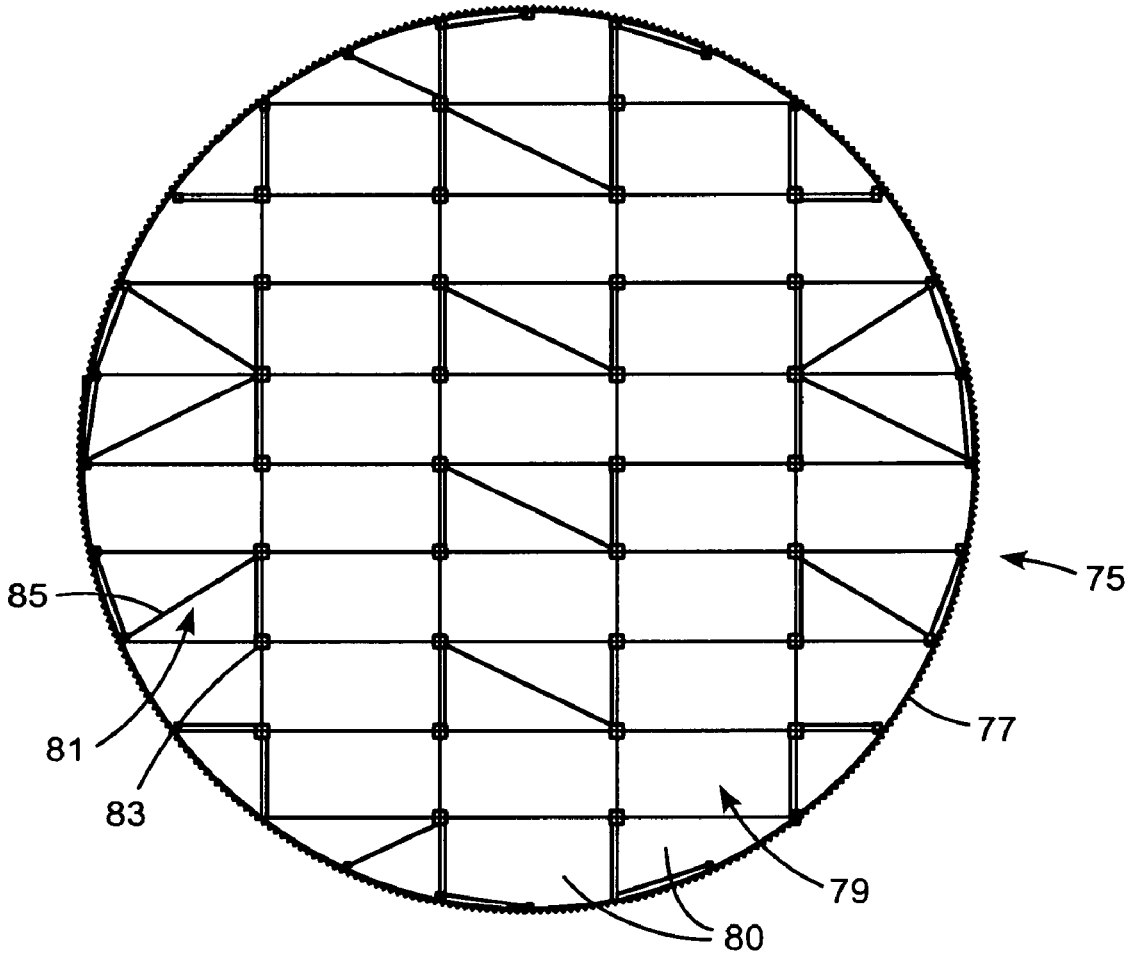
FIG. 7A is a top view of supports for the competition ring.
Figure 7B:
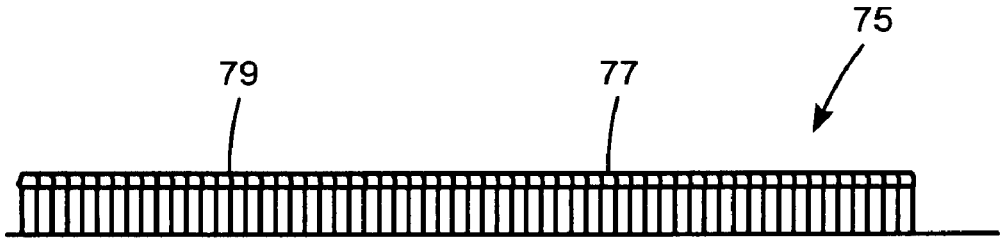
FIG. 7B is a side elevation of the competition ring of FIG. 7A.

FIGS. 7A and 7B show a roughly circular competition ring 75. The competition ring 75 may be a raised platform 79. The raised platform 79 may be supported by a series of individual supports 81. The individual supports 81 may be arranged to provide roughly equal support across the surface of the platform 79. The individual supports 81 may prevent swaying or other unwanted movement of the platform 79. The platform 79 may be divided into segments 80. The segments 80 may be rectangular or other shaped, with edge segments 80 shaped to form an overall, roughly circular shaped platform 79. The segments 80 may be reversible and absorb impacts with excessive noise. A side wall 77 of the competition ring 75 is preferably closed, but may be open or partially open.

Figure 8:
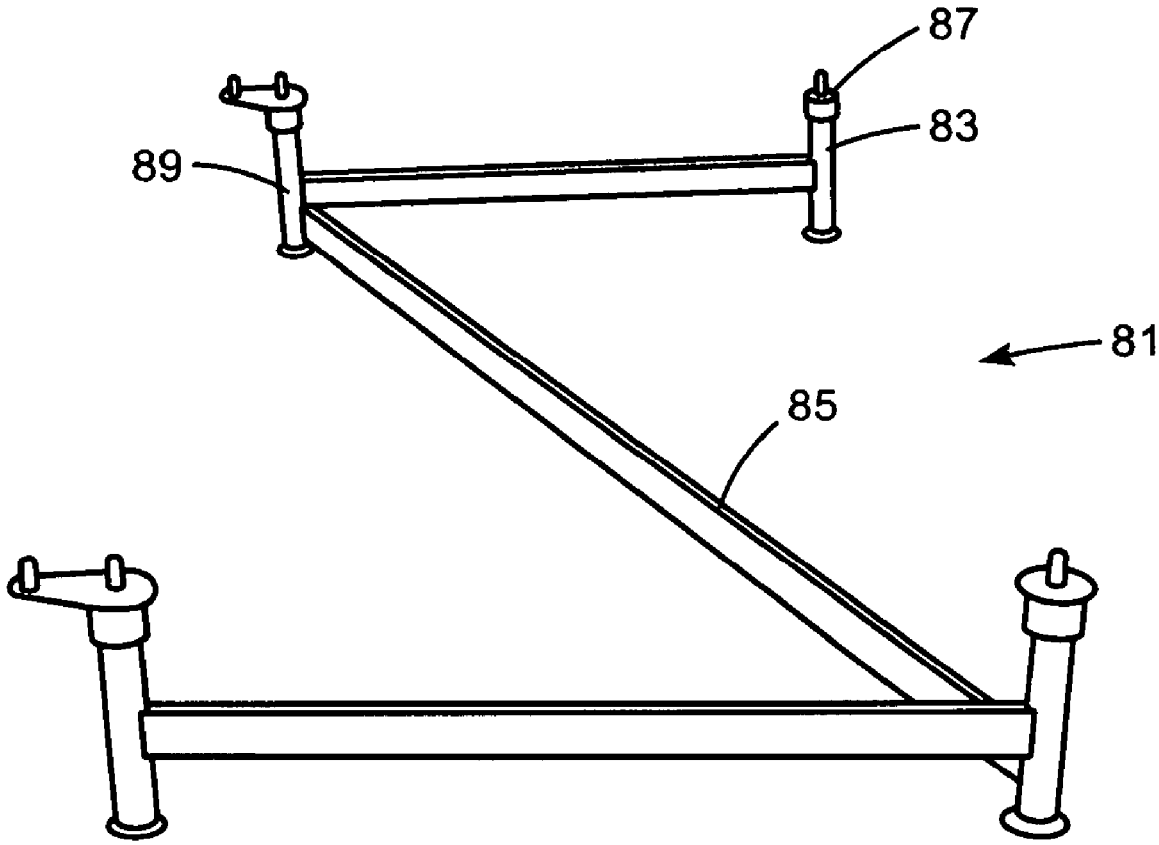
FIG. 8 is a perspective view of an individual support.

FIG. 8 is a perspective view of an individual support 81. The individual support 81 may include posts 83, connector bars 85, platform connectors 87 and hinge connectors 89. The individual supports 81 may be adjustable to provide desired support at different points around the platform 79. One or more posts 83 may be placed on the ground or any other surface supporting the competition ring 75. The individual supports 81 each preferably have three posts 83, but other numbers and configuration are possible. The connector bars 85 may be attached between the posts 83 at the hinge connectors 89. The hinge connectors 89 may allow the posts 83 to be placed at desired positions under a platform 79. The posts 83 may connect to and secure the platform 79 with platform connectors 87. The posts 83 may have adjustable feet to compensate for uneven surfaces.

The fighters preferably use gloves. All weight categories of 153 lbs/69.5 kg and lighter may use 8 oz approved gloves in professional matches. If one fighter is above 153 lbs/69.5 kg and one fighter is below, 10 oz gloves may be used. All weight categories heavier than 153 lbs/69.5 kg may use 10 oz gloves. All amateurs may use 10 oz and 12 oz gloves according to the same weight division cutoff described above. The wrapping of hands or feet may not be mandatory. Fighters who wish to wrap their hands or feet may be responsible for their own gauze and tape. Gauze may preferably be soft or soft-stretch type, and preferably does not exceed 2 inches in width. Tape may be soft adhesive type and preferably does not exceed 1.5 inches in width. Preferably one ten-yard roll of gauze and not more than two yards of tape may be the maximum allowable amounts for each hand. Preferably no other materials, including pre-made hand wraps, except as approved in amateur competition, are allowed; nor, preferably, may any amounts exceeding those listed be allowed under any circumstances. Gauze may be used preferably for protection of the hands only, and the amount of gauze used may be at the discretion of administration for the martial arts combat league or state athletic commission representatives. Tape preferably only holds gauze in place, and no more than one layer of tape may be allowed on a striking surface of a hand. Only one strip of tape may be allowed between the fingers, preferably not to exceed ¼ in width and 4" in length. Up to twelve feet of tape may be used to wrap each foot and ankle. Pre-approved neoprene angle wraps may be used instead of gauze and tape to protect and support the ankle and foot. There may be a mandatory wrap check by an event official prior to a fighter being allowed to put on their gloves and shin/instep/foot protection. Preferably no adjustment or additions are made to wraps after receiving the official's approval.

All fighters may wear approved, padded shin/instep/foot protection. All male fighters preferably wear an approved groin protector. All fighters preferably wear fitted mouthpieces. Fighters may furnish their groin protectors and mouthpieces. Fighters who do not present themselves properly equipped at the start time of the competition may be subject to fines and may be penalized by the referee, including potential disqualification. Preferably no rings, jewelry, or items other than authorized items may be worn.

Certain fighting techniques may be used including punching techniques, knee strikes and kicking techniques. Punching techniques may include jabs, crosses, hooks, uppercuts, back fists and spinning back fists directed at the face, head and front and sides of the torso (waist and above). Intentionally punching to the back of the head (from the back of the ears and behind) may be considered a foul unless the fighter receiving the blow is presenting their back in an attempt to defend or escape. Spinning back fists making contact with anything other than the padded part of the glove may be considered a foul. Spinning knife hand and hammer fist strikes may be expressly forbidden. Clinching or holding of any kind in order to strike or impede an opponent's attack may be considered a foul and may result in penalization.

Knee strikes may include forward or roundhouse knee strikes that may be delivered to the head (for professionals only), and to above the waist, to the front and side of the torso (for amateurs and professionals). Clinching or holding of any kind (including neck wrestling) in order to set up knee strikes may be considered a foul and can result in penalization. Kicking techniques may include roundhouse kicks that can be delivered to the inside and outside of the front leg, above the knee. All kicks (any type or variation) may be delivered the front and sides of the torso (above the waist) and to the head. Grabbing or holding an opponent's kicking leg in any way may be considered a foul and may result in penalization. Leg checking (stopping the momentum of an opponent's kick with the bottom of a foot) may not be allowed.

In addition to the fouls mentioned above a fighter may be penalized for attempting to use any fighting technique other than those expressly described as "legal" above. Such penalties may occur for grabbing, clinching, holding or wrestling of any kind and sweeping or throwing (as in Judo).

Additionally, penalties may be given for passivity. Passivity may exist when any of the following occur: avoiding confrontation, only fighting by countering an opponent's attack, or consistently using defensive movement to make an opponent miss without immediately countering. The referee may have broad discretion in determining and penalizing passivity. Stalling may also result in a penalty. Stalling may include any of the following: intentionally delaying the contest by a fighter not being prepared to compete, intentionally dropping or spitting out the mouthpiece or intentionally or persistently falling to the ground. The referee may have broad discretion in determining and penalizing stalling. Another penalty may be striking an opponent while the opponent is down. An opponent may be considered down when any parts of a fighter's body, other than the feet, are touching the ground. If a fighter is on the way down, the fighter's opponent may continue to attack until a part other than the fighter's feet has touched the ground. Others penalties may include: inducing a head-butt, charging inside the opponent's arms with head held low, abusive language or unsportsmanlike conduct of any kind, at any time, as determined by the referee or chief official, and/or hitting on the break.

Fighters committing fouls may rarely be warned. A penalty point (or points) may be awarded to the fouling teams' opponent each and every time a foul is committed as determined by the referee. Under certain circumstances the referee, at the referee's discretion, may award two or even three points for a foul depending on the severity.

The following rules may be applied to injured or damaged fighters. If a fighter is injured or damaged in the course of a round the referee may do the following:

If the fighter is knocked down from a legal strike the referee may send the standing fighter to the position in the ring furthest from the downed fighter. The referee may administer a count to the downed fighter (mandatory eight-count). If the downed fighter is unable to demonstrate that they are capable of continuing prior to the count of ten, the fight shall be declared a knockout for the standing fighter's team. Preferably, a fighter may not be saved by the bell in any round. If the fighter demonstrates that they are capable of continuing then that round of the contest may continue.

If a fighter is damaged by a legal blow or series of legal blows but does not go down, the referee may at their discretion: (1) allow the match to continue if the referee believes that it is safe for the athlete to continue, (2) stop the match and award a knockout victory (if the referee believes that it is not safe for the athlete to continue), or (3) administer a standing eight count (if the referee for any reason can not make a clear determination as to whether or not it is safe for the athlete to continue). Standing eight counts can be considered the same as a knockdown in terms of scoring.

If a fighter is damaged by a legal blow or series of legal blows and turns his back on his opponent, the referee may at his discretion administer a standing eight count to evaluate the fighter.

If a fighter is injured, the referee may break the action, stop time and ask the official physician to examine the fighter. The physician may decide whether or not the round can continue. The physician preferably cannot provide any treatment to the injured area during the course of that fighter's participation in the contest.

In the event that the fighter cannot continue:

(1) If the fighter injured himself or significantly contributed to his own injury as determined by the referee, the round may be scored as a total knockout for the team represented by the uninjured fighter.

(2) In the event that a no-fault foul occurs causing an injured fighter to be unable to complete the round, the judges may score the round up to the point of the foul and then the event may continue without delay with the next two combatants.

(3) In the event that a fighter fouls his opponent and the fouled fighter is unable to continue, the referee may determine whether the foul was intentional or accidental. If the foul is deemed intentional, then the fighter committing the foul may be disqualified. If it is determined that the foul was accidental, the appropriate penalty points may be awarded to the fouled fighter, and the judges may score the action that occurred in the round up to the point of the foul.

In some cases, for example, a groin kick, where the amount of damage may not be determined objectively, the damaged fighter may receive a suitable recovery time in order to continue the round, rather than immediately having the round scored up to the point of the foul.

The following rules may apply to disqualification: A fighter may be disqualified when:

(1) A fighter intentionally, repeatedly or maliciously uses a fouling technique. A fighter who executes a fouling technique that is deemed malicious (with intent of causing an jury above and beyond the scope reasonably expected in a bout of this nature), may be subject to bearing the medical, as well as related recovery and recuperation expenses of the fighter who is injured as a result of such a fouling technique.

(2) A fighter fails to follow the referee's instructions.

(3) A fighter repeatedly uses a fouling technique for any reason.

(4) A fighter exhibits ill-mannered behavior at any time, toward his opponent, his opponent's team, the referee, other officials or any fans present.

(5) A coach or team assistant has entered into the ring or touched one of the fighters during the contest.

(6) The referee determines that the fighter does not have the ability to continue fighting.

(7)A fighter does not answer the bell announcing the beginning of the round.

Disqualification may result in the round being scored in a manner identical to a defeat by knockout.

The following rules may be applied to scoring. Each round may be judged by three ringside officials using a modified "five point must" system as discussed below. Other numbers of judges may be used depending on the situation. Furthermore, other "point must" systems may be used, such as a "ten point must", "fifteen point must", or other similar systems.

In the event that, when the final two fighters complete their final round, the overall score is tied the final two fighters may compete in a sudden victory round. The points earned in the sudden victory round may determine the winning team. If the sudden victory round ends with the score still tied the judges may choose which team has earned the victory as reflected by the judges' overall sense of the contest.

The following rules may be applied to corner men conduct:

(1) A team may be allowed to have total of five coaches or team assistants at any given time in the event, including one head coach who can be at ringside during each match and four assistants or warm up coaches in the fighters' pen.

(2) The coaching staff may be obligated to wear a team wear complementary to the fighters.

(3) The head coach preferably must remain within a designated coaching area during the matches.

(4) Neither coaches nor assistants may place their hands on the competition arena during the rounds.

(5) No coach or assistant may not enter the ring or touch the fighters during the rounds.

(6) Coaches/assistants may not place any item (such as towels, etc.) on or in the ring.

(7) Referees may penalize a team if any coach/assistant does not abide by the instructions listed above.

(8) No fighter, coach, trainer and/or manager may be allowed to raise an objection to calls or decisions made by the referee or the judges. However, official written protests to an Officials' Committee are accepted within two weeks of the date of the match.

The use of protectors made of rubber or neoprene (without metal or plastic), may be used on the knee, or ankle joints. No protector of any kind may be used on the arms or elbows or anywhere else (other than the established required equipment described above). White tape and elastic tape may be used for taping of injured areas; however such dressings must be checked and signed by the official physician, commission representative or martial arts combat league representative in attendance. Preferably, all tape and/or bandages without an official signature to prove that they were checked must be removed. No tape may be applied to a fighter once the match is started.

If the mouthpiece comes out of a fighter's mouth during a match, the referee may, in principle, retrieve it and have the corner man replace it as soon as possible without interfering with the action of the bout.

All individual fighters may be obligated to submit to drug testing upon an official request. Testing positive for doping may result in penalties to include the confiscation of team purse money and the forfeiture of an event.

All fighters must preferably submit to a medical check by the official physician before competing. They must also preferably provide (in advance) whatever documented medical examinations are required in order to acquire the appropriate state athletic commission license(s).

Minimal use of Vaseline to the facial area may be allowed. Preferably, no other substance shall be applied. The term minimal in this case may mean the amount that the inspecting official permits. A fighter with an excessive amount of Vaseline on the face and/or body may not be allowed to compete. In such cases, the excessive Vaseline may be removed.

Any issues or circumstances not specifically provided for in a written set of rules may be resolved by a consensus among the presiding state athletic commission and the martial arts combat league representative.

The following are exemplary judging basics. Judges are preferably provided with a clearly defined and prioritized scoring system. Judges may be informed of what is being evaluated to determining a score, such as offense, defense, clean striking, damage, ring generalship, conditioning, etc. and of what relative importance is each factor to determining a score.

Preferably, an incremental scoring system may be used. The scoring system may allow the judges to arrive at total contest score that accurately reflects the action that occurred. The scoring system can provide each judge with the opportunity to take into consideration how a fighter wins each round (considering the scoring criteria) and by what margin.

Judges may be provided with an unobstructed and uninterrupted view of the action.

Judges preferably possess a thorough understanding of the scoring criteria and the scoring system, integrity, and a blank slate. Every round of every bout preferably starts even. Judges may actively guard against "expecting", "anticipating" or "predicting" any particular result. Judges may not be biased based on a comparison of the fighter's physical appearance and attitude, or by prior knowledge of either fighter. Additionally, a judge may not allow the results of earlier rounds to bias their perception of the current round that they are judging. A judge may simply and objectively observe, without bias or preconception, the action as it unfolds.

The following are exemplary scoring criteria for judges. Martial arts combat league rounds may be scored on whether an effective and accurate attack is recognized, and if damage is inflicted upon the opponent by authorized fighting techniques. For each round the scores indicated by the judges may reflect the comparative effectiveness of each martial arts fighter. Effectiveness as a fighter is evaluated according to the following priority based criteria (in descending order of priority): (1) number of knockdowns, (2) extent of damage inflicted on the opponent, (3) number of clean strikes scored, (4) kicking effectiveness, and (5) aggressiveness.

Priority based criteria may allow for criteria higher on the list to almost always take precedent in scoring over criteria lower on the list, regardless of number of occurrences of lower ranked criteria. For example: If Fighter A knocks down Fighter B (1), then Fighter A may win the round even if Fighter B had the advantage in the overall extent of damage inflicted (2). In a round where no knockdowns (1) occur, the fighter who inflicted the most damage (2) may win the round, even if the other fighter scored a larger number of clean scoring strikes (3). If throughout a round, neither fighter distinguishes themselves according to the primary (first three) criteria points that measure effectiveness, the judge may score in favor a fighter that demonstrated effectiveness with the most spectacular kicking skills, or the fighter who consistently was more aggressive and hence, clearly forced the action of the round to occur.

The following is an exemplary scoring system. Martial arts combat league judges may evaluate each round using a "five-point must" scoring system. For each round, each judge may award the team fielding the more effective fighter with five points, and their opponent can be awarded four or less points.

The "five-point must" system as described below may allow judges to score bouts in a way that accurately reflects what occurs during each round. As indicated previously, other "point must" systems are contemplated. The scoring system is preferably set up to take into consideration both the scoring criteria and the margin by which each round is won. A team whose fighter wins a round marginally, based solely on aggressiveness (5), for example, may not receive the same credit as a team whose fighter wins a round fairly obviously, based on greater damage inflicted on his opponent (2). The overall scoring of the contest is not a just a reflection of which team won the most rounds, but also a reflection of the how each round was won and by what margin each round was won.

5-5 Even Round

This score may rarely be used since extremely close rounds may be awarded in favor of the fighter who demonstrates the most effective, impressive kicking skills or the fighter who most forced the action of the round to occur.

The score of 5-5 should preferably only be used when neither fighter even marginally demonstrates superiority in the round according to the established criteria.

5-4 Winning the Round by a Very Narrow Margin

Generally speaking, this score may indicate that neither fighter inflicted significantly greater damage on the other. One fighter may have marginally scored a greater number of clean strikes.

This score may also be used when a fighter wins the round solely by demonstrating the more effective, impressive kicking skills or having forced the action through aggressiveness.

5-3 Winning the Round by a Clear Margin

This score may indicate that it was fairly obvious who won the round either through the comparative extent of damage inflicted, or the number of clean scoring strikes.

This score may also be used to favor a fighter who scores a knockdown, if the fighter who scored the knockdown would have lost the round by a fairly obvious margin if not for that knockdown. Since knockdowns may be highest on the prioritized criteria as described above, the knockdown may override any advantage in damage or clean blows scored by the downed opponent. The effectiveness of the downed fighter during the round, with the exclusion of being knockdown may be recognized by only scoring the round 5-3 for the fighter who scored the knockdown, rather than 5-2 as described below.

5-2 Dominating the Entire Round or Winning the Round and Scoring a Knockdown

This score may indicate a round where the winner was very obvious and was dominant throughout the entire round, i.e. constantly in control and unquestionably outclassing an opponent. A knockdown or standing eight count may have been narrowly avoided.

This score also may be used to indicate a round in which it was fairly obvious that one fighter was more effective and scored a knockdown.

5-1 Dominating the Entire Round and Scoring a Knockdown or Winning the Round plus Scoring Two Knockdowns etc.

This score may be used to indicate a round where one team's fighter was dominant throughout the entire round, i.e. constantly in control and unquestionably outclassing their opponent, plus scoring a knockdown.

This score may also be used to reflect a round in which it was fairly obvious that one fighter was more effective for the majority of the round plus scored two or more knockdowns.

5-0 Knockout, Total Knockout or Disqualification

This is preferably an automatic score awarded in favor of the team whose fighter scores a knockout, total knockout or whose opponent is disqualified for any reason.

At the conclusion of each round the judge's scores may be registered and combined, and then added to the total team points from the previous rounds. An exemplary scoring chart is provided below. The scores from each individual judge during a first round may be combined to form a round score for that round. For example, the round score for Round 1 may be 15-11, Round 2 may be 12-15, and Round 3 may be 11-15. The round scores may be added together after each round to produce a total team score. For example, the total team score after Round 1 may be 15-11, after Round 2 may be 27-26, and after Round 3 may be 38-41. Any penalties and/or bonuses may be added to the total team score after each round.

The team with the highest total team score at the end of the last round may be determined the winner of the martial arts competition. Points from each competition may accumulate over the course of a season. Teams with the highest accumulated points over the course of a season may be selected to advance to a playoff or other type of tournament. Alternatively, the team with the highest number of wins or winning percentage may advance to a playoff or other type of tournament. Other selection methods for a winning team over the course of a season may include, objective or subjective rankings, round robin tournament play, best record or highest accumulated points over the course of a season or other methods.

TABLE I

| Judge A | Judge B | Judge C | Round Score | Total Team Score to This Point in the Contest |
|---|---|---|---|---|
| | | | ROUND 1 | |
| 5-4 | 5-4 | 5-3 | 15-11 | 15-11 |
| | | | ROUND 2 | |
| 4-5 | 4-5 | 4-5 | 12-15 | 27-26 |
| | | | ROUND 3 | |
| 3-5 | 4-5 | 4-5 | 11-15 | 38-41 |

A martial arts league in accordance with the principles of the invention may appeal to a variety of market segments. A first market segment may be martial arts participants. Martial arts participants may already be fans of martial arts and may be actively involved in martial arts by taking classes or bringing their children to classes. The martial arts participants' familiarity and enjoyment of martial arts makes the martial arts participants an ideal initial fan base for a martial arts combat league. Another market segment may be individuals that consider themselves as martial arts enthusiasts. Martial arts enthusiasts may enjoy watching martial arts themed movies and martial arts on television. Most martial arts enthusiasts may have taken martial arts classes at one time or enrolled their children in martial arts classes. Another market segment may be individuals that watch niche team or contact spectator sports. Niche spectator sport watchers may either attend niche sporting events such as boxing, motocross, bowling, bull riding, board sports, extreme sports, auto racing and bike racing. Generally, niche spectator sport watchers may attend sporting events that appeal to a sense of excitement. Sporting events that are reasonably priced may further appeal to niche spectator sport watchers. Niche spectator sport watchers may watch niche sports on television if there is compelling, unpredictable action. Another market segment may be curious fans. Curious fans may include traditional sports fans that attends games such as basketball, football and baseball and/or watches these games on television. Curious fans may be attracted to the martial arts combat league of the present invention through promotions and advertising. Another market segment may be casino patrons attracted to martial arts combat league events held at a casino. Casino patrons may be brought to martial arts combat league events through in-house promotion at the casino.

Although the foregoing description is directed to the preferred embodiments of the invention, it is noted that other variations and modifications can be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. An apparatus for a martial arts competition, the apparatus comprising:

a platform without ropes or corners for martial arts competitors, the platform comprising;

an inner horizontal surface;

a sloped ramp surrounding the inner horizontal surface; and color-coded zones on the platform, wherein the inner horizontal surface is a first color, and wherein the sloped ramp is a second color, wherein the platform is generally circular; and one or more supports for the platform.

2. The apparatus of claim 1, wherein the sloped ramp comprises an up slope on an inner portion of the sloped ramp and a down slope on an outer edge of the sloped ramp.

3. The apparatus of claim 2, wherein the up slope is on an inner portion of the sloped ramp.

4. The apparatus of claim 2, wherein the down slope is on an outer edge of the sloped ramp.

5. The apparatus of claim 1, further comprising a safety platform surrounding the sloped ramp.

6. The apparatus of claim 1, wherein martial arts competition is a team martial arts competition.

7. The apparatus of claim 1, wherein the platform is a raised platform.

8. The apparatus of claim 1, wherein the platform further comprises a track surrounding the inner horizontal surface.

9. The apparatus of claim 8, wherein the track is a third color.

10. The apparatus of claim 1, wherein the color-coded zones on the platform are tied to martial arts competition rules, wherein the inner horizontal surface is a main competition region and entry of a martial arts competitor into the sloped ramp is a cause for breaking action.

11. The apparatus of claim 1, wherein the platform is circular.

12. The apparatus of claim 1, wherein the inner horizontal surface is approximately 12 to approximately 25 feet in diameter.

13. The apparatus of claim 1, wherein the sloped ramp slopes at a grade of approximately 14% for approximately five feet.

14. The apparatus of claim 1, wherein the platform absorbs impacts with excessive noise.

15. The apparatus of claim 1, wherein the platform is covered with vinyl canvas.

16. The apparatus of claim 1, wherein the platform comprises one or more interlocking soft sparring mats.

17. The apparatus of claim 16, wherein the one or more interlocking soft sparring mats sit on a foam base.

18. The apparatus of claim 1, wherein the sloped ramp comprises a ring structure.

19. The apparatus of claim 18, wherein the ring structure is covered with bonded foam or one or more soft sparring mats.

20. The apparatus of claim 19, wherein the bonded foam or one or more soft sparring mats are covered with spandex.

21. The apparatus of claim 18, wherein the ring structure is coupled to the platform using a hook and loop perimeter fasteners.

22. The apparatus of claim 1, wherein the platform is divided into segments that combine to form the generally circular platform.

* * * * *